US005307105A

United States Patent [19]

Saotome et al.

[11] Patent Number: 5,307,105

[45] Date of Patent: Apr. 26, 1994

[54] PHOTOSENSITIVE MATERIAL DRYING DEVICE

[75] Inventors: Shigeru Saotome; Ichizo Toya, both of Kanagawa, Japan

[73] Assignee: Fuji Photo Film Co., Ltd., Kanagawa, Japan

[21] Appl. No.: 956,971

[22] Filed: Oct. 6, 1992

[30] Foreign Application Priority Data

Oct. 8, 1991 [JP] Japan ..... 3-260862

[51] Int. Cl.[5] ..... G03D 13/00

[52] U.S. Cl. ..... 354/298

[58] Field of Search ..... 354/298, 303, 324, 299, 354/319-323, 300; 355/30; 34/52

[56] References Cited

U.S. PATENT DOCUMENTS 5,160,399 11/1992 Ueda et al. ..... 34/52

FOREIGN PATENT DOCUMENTS 2-277058 11/1990 Japan .

2-277059 11/1990 Japan .

*Primary Examiner*—D. Rutledge

*Attorney, Agent, or Firm*—Sughrue, Mion, Zinn, Macpeak & Seas

[57] ABSTRACT

A photosensitive material drying device having a plurality of far infrared radiation heaters disposed in facing relationship so as to meet at right angles to the direction in which an exposed film is conveyed. The density of the film is measured before the film is heated by the far infrared radiation heaters. Upon heating of the film by the far infrared radiation heaters, the surface temperature of each of the far infrared radiation heaters is changed by a variable resistor in accordance with the measured density to thereby vary the amount of heat applied to the film. It is therefore possible to satisfactorily dry the film in accordance with a variation in the density of the film.

9 Claims, 5 Drawing Sheets

PHOTOSENSITIVE MATERIAL DRYING DEVICE

BACKGROUND OF THE INVENTION

1. Field of the Invention:

The present invention relates to a photosensitive material drying device for drying a photosensitive material with radiant heat, which is suitable for use in, for example, an automatic developing machine.

2. Description of the Related Art:

In an automatic developing machine, photosensitive material such as photographic film (hereinafter called "film"), photographic paper, etc. are subjected to developing, fixing and washing processes while being conveyed by rollers, followed by transfer to a drying unit, where a drying process is carried out.

As an example, an automatic film developing machine is discussed below. In general, the drying unit is provided with a drying device, which has a plurality of far infrared radiation heaters disposed therein along the direction orthogonal to a film conveying direction, i.e., along the transverse direction of the film, and a plurality of reflectors disposed behind the far infrared radiation heaters in confronting relationship with the film.

When the wavelength of far infrared radiation generated from each of the far infrared radiation heaters is about 4 to 5 $\mu$m for each surface temperature of each of the far infrared radiation heaters as shown in FIG. 6, the amount of heat radiated from each of the far infrared radiation heaters increases. In addition, a difference develops between the transmissivity of far infrared radiation through a film at the time that the density D is about 0.6 (i.e., $D \approx 0.6$)(halftone) and the transmissivity of far infrared radiation through the film at the time that the density D is about 0.1 to 0.2 (i.e., $D \approx 0.1$ to 0.2)(non-exposed original image) as illustrated in FIG. 7.

Thus, even if the amount of heat applied to the film is kept constant, the amount of heat to be actually absorbed by film changes depending on the density of the film. Thus, as the density of the film becomes higher, the amount of heat absorbed by the film increases.

In a radiant-heat drying process using such far infrared radiation heaters, when the density of the film is high, the film is changed in a short time from a constant-drying-rate condition where the drying speed of the film is fast, water or moisture adhered to the surface of the film is used as latent heat vaporization and the surface temperature of the film is kept constant, to a falling-drying-rate condition where the surface temperature of the film is raised due to a reduction in the moisture on the surface of the film. When the radiant-heat drying process continues in the falling-drying-rate condition as it is, the surface temperature of the film increases excessively. As a result, the film tends to become very glossy and lacks uniformity. Further, the film is liable to curl and melt. While the amount of heat radiated from the far infrared radiation heaters can be adjusted in advance when the density of the film is high, the film drying process cannot be sufficiently carried out when the density of the film is low.

Therefore, a photosensitive material drying device of a type wherein hot-air suppliers are provided together with far infrared radiation heaters to determine, based on the percentage of moisture content and the like of a film, whether the film is in a constant-drying-rate condition or a falling-drying-rate condition has been disclosed in Japanese Patent Application Laid-Open No. 3-54560. With this device, when the film is changed from the constant-drying-rate condition to the falling-drying-rate condition, radiant-heat drying by the far infrared radiation heaters is changed over to hot-air drying performed by the hot-air suppliers to thereby dry the film by controlling an increase in the temperature of the film being dried by hot-air drying.

However, in the above-described conventional photosensitive material drying device, it is necessary to provide both the far infrared radiation heaters and the hot-air suppliers and to change over radiant-heat drying to hot-air drying. Thus, the mechanism of the photosensitive material drying device is complicated.

SUMMARY OF THE INVENTION

With the foregoing problems in view, it is an object of the present invention to provide a photosensitive material drying device capable of carrying out a satisfactory drying process by radiant-heat drying in accordance with a variation in the density of a photosensitive material.

According to one aspect of the present invention, there is provided a photosensitive material drying device for drying an exposed photosensitive material with heating means disposed in facing relationship to the photosensitive material so as to meet at right angles to a photosensitive-material conveying direction and to have substantially the same dimension as the transverse dimension of the photosensitive material. The photosensitive material drying device comprises density measuring means for measuring the density of the photosensitive material before the heating of the photosensitive material by the heating means and amount-of-heat varying means for varying the amount of heat applied to the photosensitive material in accordance with the density of the photosensitive material measured by the density measuring means.

According to the above construction, the density of the photosensitive material is first measured by the density measuring means. The amount of heat applied to the photosensitive material is then changed by the amount-of-heat varying means in accordance with the density of the photosensitive material, which has been measured by the density measuring means. That is, when the density of the photosensitive material is high, the amount of heat applied to the photosensitive material decreases. When, on the other hand, the density of the photosensitive material is low, the amount of heat applied to the photosensitive material increases. Thus, the amount of heat to be absorbed by the photosensitive material is equally maintained in spite of a variation in the density of the photosensitive material.

Thus, the surface temperature of the photosensitive material is not excessively raised even if the density of the photosensitive material is high. In addition, an increase in gloss and nonuniformity due to an increase in temperature is prevented and the photosensitive material doesn't curl up. It is also possible to satisfactorily dry the photosensitive material irrespective of the density of the photosensitive material.

The above and other objects, features and advantages of the present invention will become apparent from the following description and the appended claims, taken in conjunction with the accompanying drawings in which a preferred embodiment of the present invention is shown by way of illustrative example.

DETAILED DESCRIPTION OF THE PREFERRED EMBODIMENTS

Figure 2:
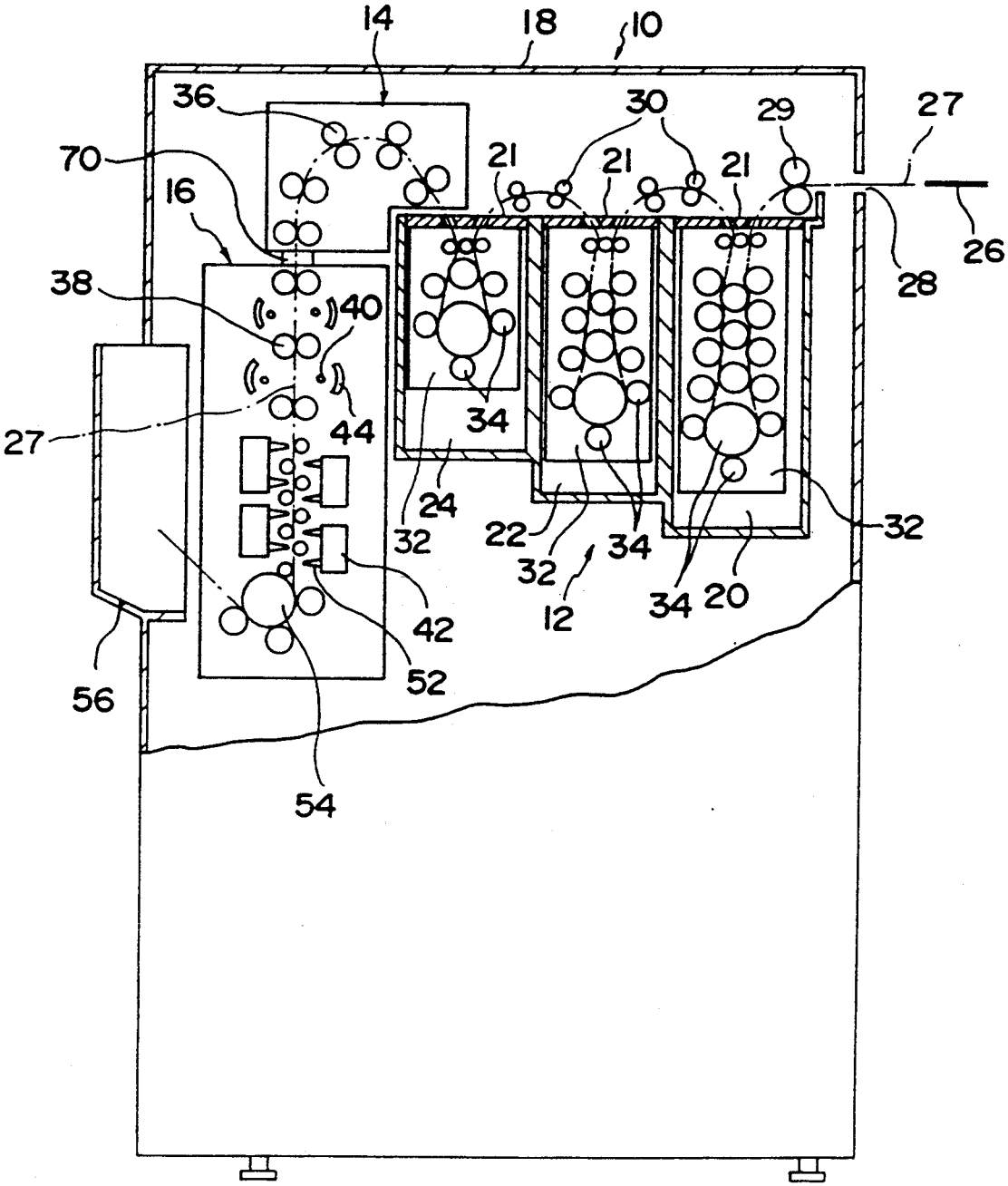
FIG. 2 is a schematic vertical cross-sectional view illustrating an automatic developing machine provided with the photosensitive material drying device shown in FIG. 1.

FIG. 2 shows an automatic developing machine 10 provided with a photosensitive material drying device according to one embodiment of the present invention.

The automatic developing machine 10 comprises a processing unit 12, a squeezing unit 14 and a drying unit 16, all of which are accommodated within a housing 18.

The processing unit 12 is disposed in an upper position within the housing 18 and comprises a developing tank 20, a fixing tank 22 and a washing tank 24. A a sheet-like X-ray film (hereinafter called a "film 26"), which is one example of a photosensitive material, is conveyed along a conveying path 27 indicated by the alternate long and short dash line in FIG. 2. That is, the film 26 is inserted through a film insertion slot 28 defined in an upper portion of a right side wall of the housing 18, then interposed between a pair of insertion rollers 29 disposed in the vicinity of the film insertion slot 28 and conveyed. Thereafter, the film 26 is successively fed into the developing tank 20, the fixing tank 22 and the washing tank 24 by being conveyed by conveying rollers 30 disposed in upper positions between the respective adjacent tanks and roller groups 34 disposed in the respective tanks and supported by respective conveying racks 32, whereby developing, fixing and washing processes are carried out. A developer, a fixing liquid and a washing liquid serving as processing liquids are circularly supplied to the developing tank 20, the fixing tank 22 and the washing tank 24 respectively. Floating covers 21 each having a pair of apertures for inserting the film 26 therethrough and taking it out therefrom are disposed on their corresponding processing liquids. The floating covers 21 prevent the processing liquids from being in unnecessary contact with air.

Incidentally, an unillustrated auto-feeder for automatically inserting the film 26 into the film insertion slot 28 can be mounted to a position in the vicinity of the film insertion slot 28.

The squeezing unit 14 is adjacently provided on the left side of the washing tank 24. After being subjected to washing in the washing tank 24, the film 26 is interposed between and conveyed by conveying rollers 36. Any water or moisture, which has adhered to the surface of the film 26, is squeezed off during this film conveying process.

Figure 1:
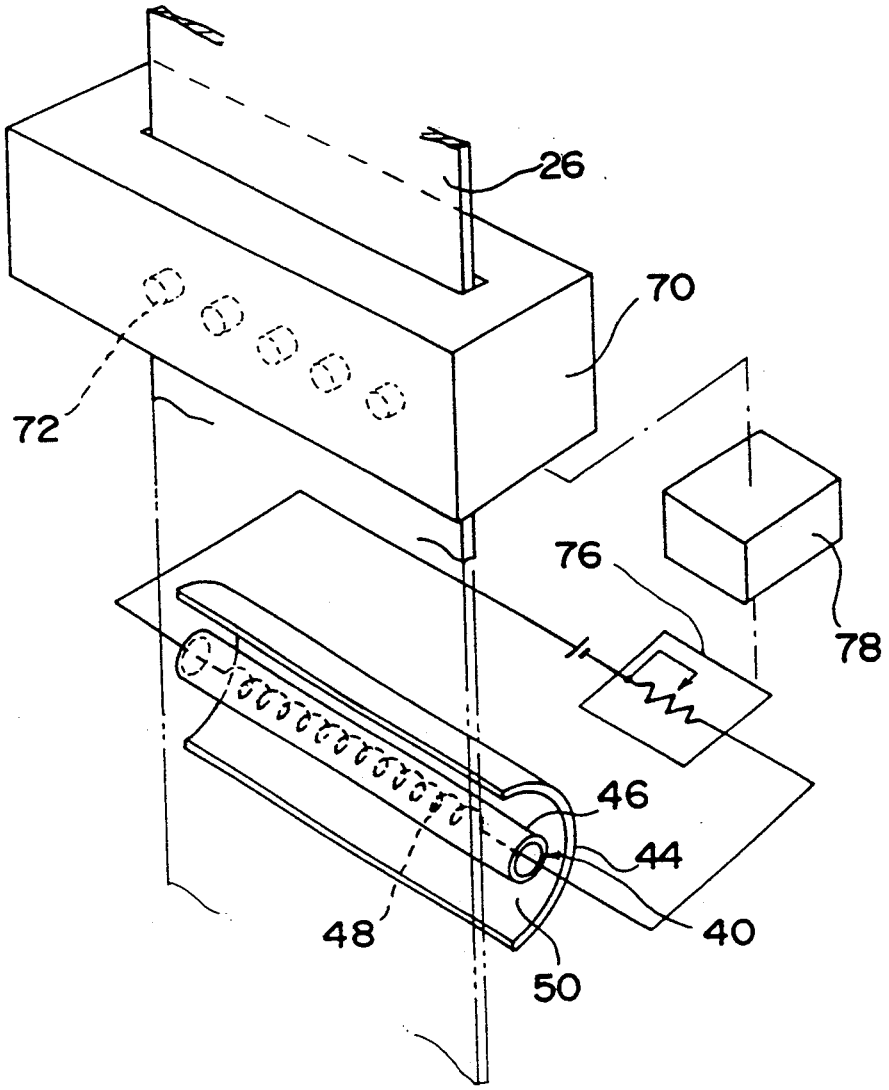
FIG. 1 is a perspective view showing a photosensitive material drying device according to one embodiment of the present invention.

A density measuring unit 70 is disposed below the squeezing unit 14. The density measuring unit 70 is provided with a plurality of densitometers 72 serving as density measuring means as shown in FIG. 1. Each of the densitometers 72 logarithmically measures the density of a photo-transmissive portion (point to be measured) of the film 26 by making use of a photoelectric tube and an ammeter.

Figure 4:
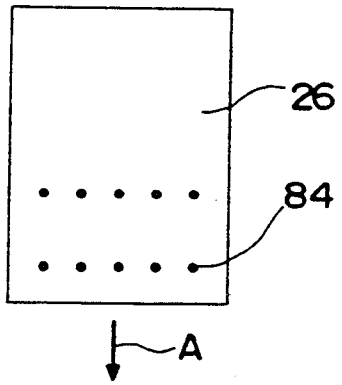
FIG. 4 is a view for describing the measurement of density of a film.

As shown in FIG. 4, a total of ten points 84 to be measured are provided in two rows each having five measuring points over a range from 10 cm to 20 cm in length from the leading end of the film 26 as seen in a film conveying direction (i.e., the direction indicated by the arrow A) provided that the direction orthogonal to the direction in which the film 26 is conveyed is taken as a row direction. The five densitometers 72 shown in FIG. 1 are provided so as to meet the number of the measuring points 84 disposed in one row. The five densitometers 72 first measure the densities of the five measuring points 84 disposed in the first row. Then, the five densitometers 72 measure the densities of the five measuring points 84 disposed in the second row in accordance with the conveyance of the film 26. The entire density of the film 26 is represented by the density obtained by averaging the densities of the ten measuring points 84.

Figure 5:
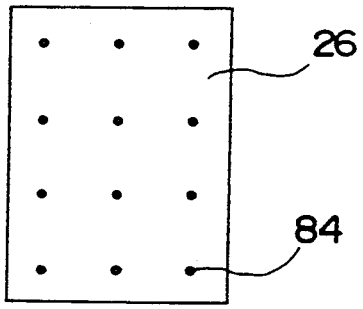
FIG. 5 is a view for describing the measurement of density of another film.
Figure 6:
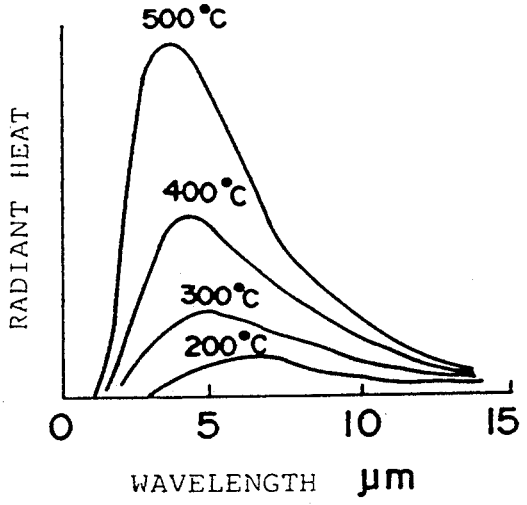
FIG. 6 is a graph for describing the relationship between the amount of radiant heat radiated from a far infrared radiation heater and the wavelength of infrared radiation.
Figure 7:
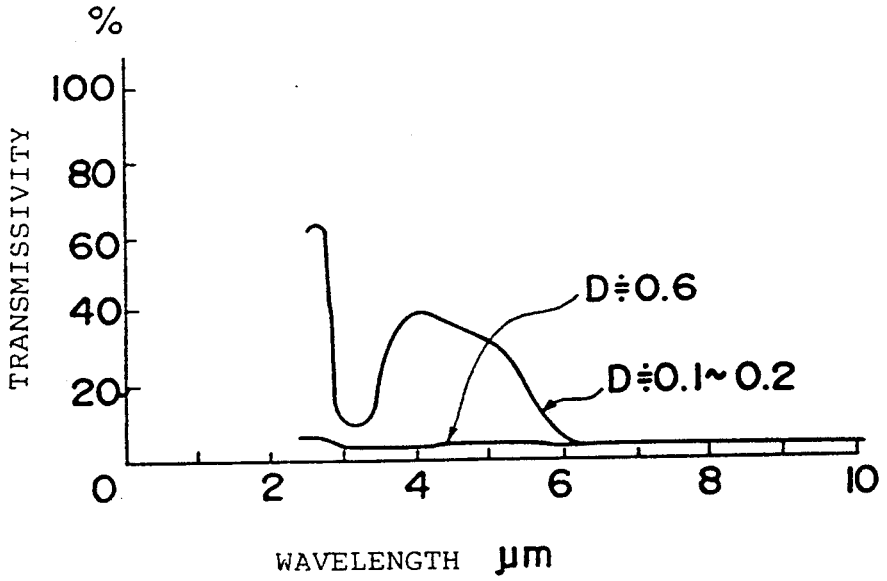
FIG. 7 is a graph for describing the relationship between the transmissivity of infrared radiation through a film and the wavelength of the infrared radiation.

A total of twelve measuring points 84 are provided in four rows each having three measuring points 84 over the entirety of the film 26 as shown in FIG. 5. Three densitometers 72 are provided depending on the number of the measuring points 84 disposed in each row. The three densitometers 72 measure the densities of the measuring points 84 disposed in the respective rows in accordance with the delivery of the film 26. Thus, the entire density of the film 26 is represented by the density obtained by averaging the densities of the twelve measuring points 84.

As shown in FIG. 2, the drying unit 16 is disposed below the density measuring unit 70. In the drying unit 16, far infrared radiation heaters 40 serving as heating means dry the film 26 with radiant heat while the film 26 is being conveyed downward by conveying rollers 38.

Figure 3:
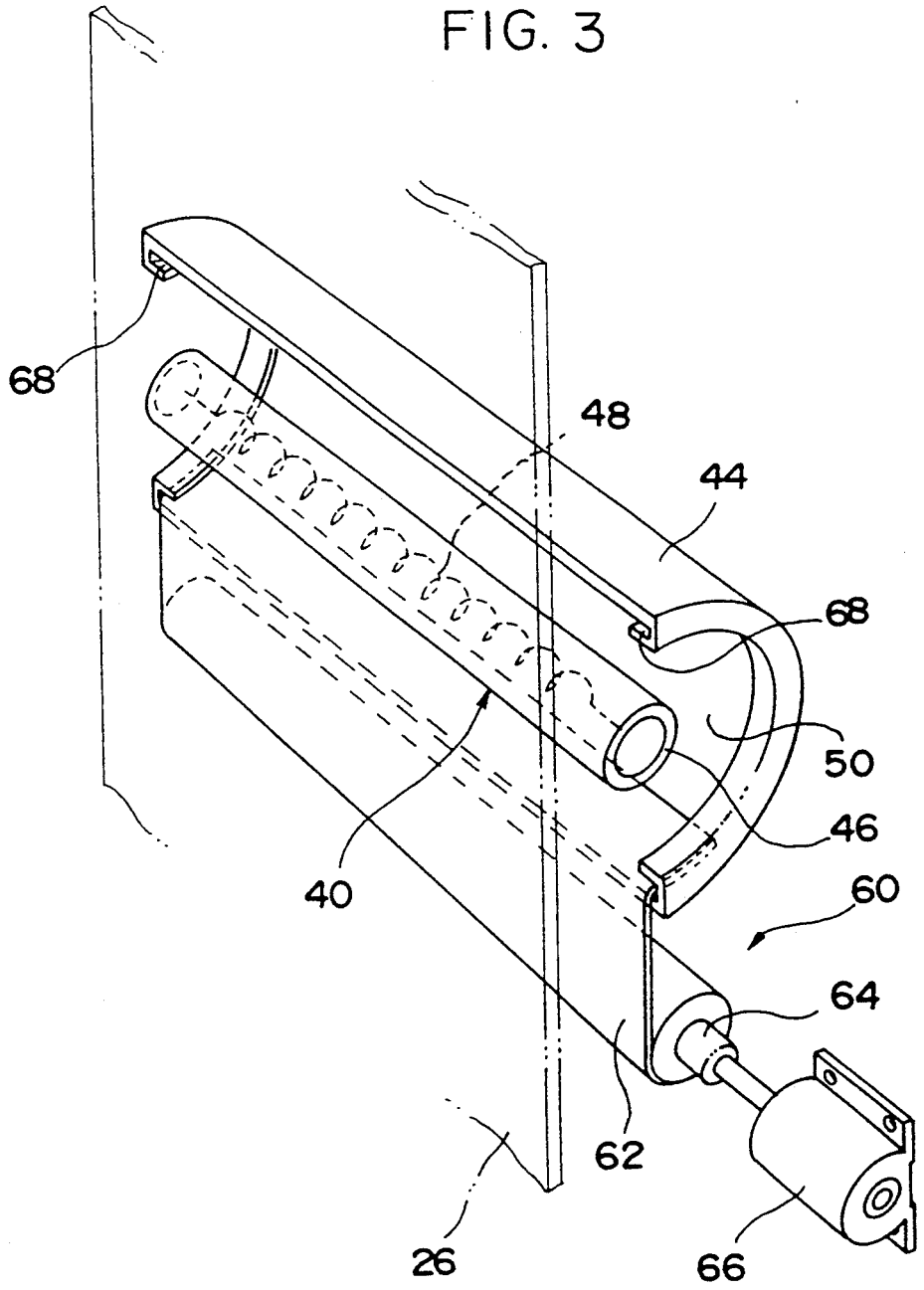
FIG. 3 is a perspective view showing an amount-of-heat varying means employed in the photosensitive material drying device shown in FIG. 1.

Two pairs of far infrared radiation heaters 40 are provided in upper and lower positions and in a facing relationship to both sides of the film 26 so that the film 26 is conveyed therebetween. As shown in FIGS. 1 and 3, each of the far infrared radiation heaters 40 is constructed such that a coiled nichrome wire 48 serving as a heat source is accommodated in a cylindrical ceramic tube 46. The radiant heat serving as the far infrared radiation is radiated over the film 26 by applying a desired voltage to the nichrome wire 48. The far infrared radiation heaters 40 are disposed in confronting relationship so as to meet at right angles to the direction in which the film 26 is conveyed. That is, the longitudinal direction of each of the far infrared radiation heaters 40 represents the transverse direction of the film 26, whereas the lengthwise dimension of each of the far infrared radiation heaters 40 is substantially identical to the transverse dimension of the film 26.

Respective pairs of reflectors 44 are disposed on the far infrared radiation heater 40 side opposite the film 26. As shown in FIG. 1, the reflector 44 is shaped in the form of an arcuate semi-cylinder having the center of curvature on the far infrared radiation heater 40 side. In addition, the reflector 44 reflects far infrared radiation radiated from the far infrared radiation heater 40 toward the reflector 44, which reflects the far infrared radiation toward the film 26 to thereby cause the far infrared radiation emitted from the far infrared radiation heater 40 to efficiently reach the film 26.

On the other hand, the quantity of heat subjected to the film 26 can be varied by an amount-of-heat varying means. As shown in FIG. 1, the amount-of-heat varying means comprises a variable resistor 76 disposed in a circuit. The variable resistor 76 varies the voltage applied across the nichrome wire 48 and changes the surface temperature of the far infrared radiation heater 40. Thus, the amount of heat radiated from the far infrared radiation heater 40 changes so as to vary the amount of heat applied to the film 26 directly from the far infrared radiation heater 40 and indirectly from the reflector 44.

As illustrated in FIG. 3, a shutter device 60 is provided as the amount-of-heat varying means. The shutter device 60 is constructed in such a manner that one end of a shutter curtain 62 is wound onto a take-up spindle 64 disposed along the longitudinal direction of the far infrared radiation heater 40. Transversely-extending edges of the shutter curtain 62 are supported by corresponding guide grooves 68 defined in both ends of the reflector 44 in such a manner that they can be pulled from or wound onto the take-up spindle 64 along a reflecting surface 50 of the reflector 44. The shutter curtain 62 has either a non-reflective characteristic of the far infrared radiation or a characteristic making it hard to reflect the far infrared radiation. The shutter curtain 62 is comprised of a heat resistant material such as a metallic thin plate, asbestos, glass fiber, polyamide resin, and which has been colored in black. The reflecting surface 50 of the reflector 44 is shielded in accordance with the extent to which the other end of the shutter curtain 62 is pulled along the reflecting surface 50 of the reflector 44 so as to vary a reflecting area. Thus, the amount of heat reflected toward the film 26 from the reflector 44 changes correspondingly, so that the amount of heat applied to the film 26 directly from the far infrared radiation heater 40 and indirectly from the reflector 44 is varied.

On the other hand, the take-up spindle 64 is rotated by a drive motor 66.

Incidentally, a conveying-speed variable device may be provided as the amount-of-heat varying means to vary the rotational speed of the rotatably-driven paired conveying rollers 38 (see FIG. 2) in such a way as to increase or decrease the conveying speed of the film 26, thereby making it possible to change the time required to supply the amount of heat applied to the film 26 directly from the far infrared radiation heater 40 and indirectly from the reflector 44.

A cold air supply device may also be provided as the amount-of-heat varying means to cause either cold air or moist air to blow against the film 26 in such a way as to vary the temperature, thereby varying the amount of heat subjected to the film 26.

As shown in FIG. 1, each of the abovedescribed amount-of-heat varying means is controlled by a controller 78 in accordance with the density of the film 26, which has been measured by each of the densitometers 72. When the variable resistor 76 is used as the amount-of-heat varying means, the voltage applied across the nichrome wire 48 of the far infrared radiation heater 40 is varied in such a manner that the surface temperature of the far infrared radiation heater 40 is reduced in accordance with an increase in the average density of the film 26 as shown in Table 1. When, on the other hand, a device for causing either cold air or moist air to blow against the film 26 so as to make it possible to vary the temperature is used as the amount-of-heat varying means in place of the variable resistor 76, the temperature of air, which blows against the film 26, is varied in such a manner that the air temperature is reduced in accordance with an increase in the average density of the film 26 as shown in Table 2.

TABLE 1

| Average temperature D | Surface temperature of far infrared radiation heater °C. |
|---|---|
| 0 ~1 | 350 |
| 1 ~2 | 300 |
| 2 ~ | 250 |

TABLE 2

| Average temperature D | Temperature of air °C. |
|---|---|
| 0 ~1 | 60 |
| 1 ~2 | 50 |
| 2 ~ | 40 |

When the surface temperature of the far infrared radiation heater 40 is changed, the wavelength of the far infrared radiation radiated from the far infrared radiation heater 40 also varies according to the change in its surface temperature. When, on the other hand, the reflectivity of the reflector 44 is changed, the wavelength of the far infrared radiation does not vary. Therefore, the control of the amount of heat applied to the film 26 is extremely easy.

As shown in FIG. 2, the drying unit 16 has a plurality of hot-air suppliers 42 disposed below the pair of far infrared radiation heaters 40. The hot-air suppliers 42 are provided in two pairs in upper and lower positions in such a way that the film 26 is conveyed therebetween. The hot-air suppliers 42 are disposed in facing relationship to both sides of the film 26. Each of the hot-air suppliers 42 allows the hot air to blow against the film 26 from a pair of blow nozzles 52. However, a satisfactory drying process can be carried out even when only the heating means is used without providing the hot-air suppliers 42.

After being dried, the film 26 is moved in an oblique upward direction by a guide roller 54 so as to be received in an opened film receiving case 56 formed in a central portion of a left side wall of the housing 18.

The operation of the present embodiment will now be described below.

The film 26 is first inserted into the housing 18 through the film insertion slot 28 and then subjected to developing, fixing and washing processes in the processing unit 12.

The film 26 thus processed is conveyed to the squeezing unit 14, where excess water or moisture is removed. Thereafter, the density of the film 26 is measured by each of the densitometers 72.

Next, the film 26 is conveyed to the drying unit 16 and subjected to radiant-heat drying by the far infrared radiation heaters 40. At this time, the amount of heat applied onto the film 26 is varied according to the density of the film 26, which has been measured by each of the densitometers 72.

When the variable resistor 76 is used as the amount-of-heat varying means, the voltage applied across the nichrome wire 48 of the far infrared radiation heater 40 is changed. When the shutter device 60 is used as the amount-of-heat varying means, the extent of pulling of the shutter curtain 62 is changed. Further, when the conveying-speed variable device is used as the amount-of-heat varying means, the conveying speed of the film 26 is changed. When the cold air supply device is employed as the amount-of-heat varying means, the temperature of the cold air supplied from the cold air supply device is varied.

That is, when the density of the film 26 is high, the amount of heat subjected to the film 26 is reduced. On the other hand, when the density of the film 26 is low, the amount of heat applied to the film 26 increases. Thus, the amount of heat to be actually absorbed by the film 26 is equal in spite of variations in the density of the film 26.

Accordingly, even if the density of the film 26 is high, the surface temperature of the film 26 is not excessively raised. In addition, problems concerning gloss and non-uniformity, which occur due to an increase in temperature, can be avoided. The film 26 can also be prevented from curling.

Thus, the film 26 can be sufficiently dried depending on variations in the density of the film 26.

The present invention has shown a process for drying an X-ray film as an illustrative example. However, the present invention is not necessarily limited to the above-described embodiment. It is needless to say that various changes can be made. The above-described embodiment illustrates a case in which the drying device is disposed in the drying unit 16, for example. However, the present invention is not necessarily limited to this case. The drying device may also be disposed in the squeezing unit 14. Thus, a further reduction in the time required to dry the film in the drying unit 16 can be made. Further, far infrared radiation heaters have been used as the heating means in the above-described embodiment. However, any type of heater, which can heat a photosensitive material with its radiant heat, may be used.

In the present invention as well, it is not always necessary to dry the film with hot air so long as a satisfactory drying process is carried out by the above-described heating means in accordance with variations in the density of a photosensitive material.

Having now fully described the invention, it will be apparent to those skilled in the art that many changes and modifications can be made without departing from the spirit or scope of the invention as set forth herein.

What is claimed is:

1. A photosensitive material drying device, for drying a wet-processed, exposed photosensitive material, comprising:

a means for heating the wet-processed, exposed photosensitive material, said means for heating disposed in facing relationship to said wet-processed, exposed photosensitive material;

a means for measuring a density of said wet-processed, exposed photosensitive material before heating the wet-processed, exposed photosensitive material by said heating means; and a means for varying the amount of heat applied to said wet-processed, exposed photosensitive material and which is connected to the means for measuring the density, wherein the heat applied to the wet-processed, exposed photosensitive material varies in accordance with the density of the wet-processed, exposed photosensitive material.

2. A photosensitive material drying device according to claim 1, wherein said means for heating comprises far infrared radiation heater each having a heat source inserted into a ceramic tube and a reflector for reflecting heat generated from said far infrared radiation heater toward said photosensitive material.

3. A photosensitive material drying device according to claim 1, wherein said means for measuring density is disposed in plural form along the transverse direction of a photosensitive-material conveying path and logarithmically measures the density of a phototransmissive portion of said photosensitive material by using a photoelectric tube and an ammeter.

4. A photosensitive material drying device according to claim 1, wherein said means for measuring density measures the densities of respective measuring points uniformly dispersed over said photosensitive material.

5. A photosensitive material drying device according to claim 1, wherein said means for measuring density measures the densities of respective measuring points formed at the leading end of said photosensitive material.

6. A photosensitive material drying device according to claim 1, wherein said means for varying the amount of heat comprises a cold-air supply device for blowing cold air against said photosensitive material.

7. A photosensitive material drying device according to claim 2, wherein said means for varying the amount of heat comprises a variable resistor for varying voltage applied across a nichrome wire inserted into the ceramic tube as the heat source.

8. A photosensitive material drying device according to claim 2, wherein said means for varying the amount of heat comprises a shutter for varying the amount of a reflecting area of said reflector.

9. A photosensitive material drying device according to claim 2, wherein said means for varying the amount of heat comprises a conveying-speed variable device for varying the conveying speed of said photosensitive material which is to be dried by said means for heating.

* * * * *